United States Patent [19]

Cervin

[11] 4,033,463

[45] July 5, 1977

[54] WORK-FACILITATING APPARATUS FOR LINING CONVERTERS, METALLURGICAL FURNACES, HOLDING VESSELS AND LIKE EQUIPMENT

[75] Inventor: Gunnar Cervin, Malmo, Sweden

[73] Assignee: Cervinter AB, Malmo, Sweden

[22] Filed: Feb. 17, 1976

[21] Appl. No.: 658,667

[30] Foreign Application Priority Data

| | | |
|---|---|---|
| Feb. 17, 1975 | Sweden | 7501704 |
| Apr. 7, 1975 | Sweden | 7503930 |
| Sept. 12, 1975 | Sweden | 7510234 |

[52] U.S. Cl. ..... 214/1 H; 52/749; 198/801; 198/812; 264/30; 214/89; 432/3

[51] Int. Cl.[2] ..... B66B 9/20

[58] Field of Search ..... 214/1 H, 623, 625, 95 R, 214/89; 198/139, 801, 812; 52/747, 749; 432/3; 264/30

[56] References Cited

UNITED STATES PATENTS 3,684,079 8/1972 Kuehl ..... 198/139

FOREIGN PATENTS OR APPLICATIONS 1,325,256 3/1963 France ..... 52/749

*Primary Examiner*—Robert J. Spar
*Assistant Examiner*—George F. Abraham
*Attorney, Agent, or Firm*—Wenderoth, Lind & Ponack

[57] ABSTRACT

An apparatus for facilitating the conveyance of material and the erection of walls of closed circumference from bricks, such as refractory bricks, and particularly for lining converters, metallurgical furnaces, such as blast-furnaces, holding vessels etc. includes a vertical frame for supporting a working platform. The apparatus further includes a conveyer means comprising a vertical conveyance path for conveying material to the platform and a supply path for conveying material to the vertical conveyance path. The vertical conveyance path and the supply path are constituted by two runs of an endless conveyor. One of the runs is extendable by shortening of the other run and vice versa.

23 Claims, 15 Drawing Figures

37''
85
37
86
82
84
80
81

37''
37

82
84
75
86
30
83

WORK-FACILITATING APPARATUS FOR LINING CONVERTERS, METALLURGICAL FURNACES, HOLDING VESSELS AND LIKE EQUIPMENT

BACKGROUND OF THE INVENTION

This invention relates to an apparatus for facilitating the conveyance of material and the erection of walls of closed circumference from bricks, such as refractory bricks, and particularly for the lining of converters, metallurgical furnaces, holding vessels and like equipment.

It is previously known in lining converters to utilize raisable and lowerable working platforms which are carried by frames and which can be moved up or down in the converter as the work proceeds and to which the material is conveyed from ground level by means of conveyers. The bricks are transported on pallets to the working site, for instance by a truck which places the pallets carrying the bricks of desired sizes and shapes on pallet tables, and from the pallet tables the bricks are placed, in the size-and-shape order indicated by the masonry drawing, for conveyance on a conveyer to a location below (or above) the converter from where the bricks are transferred to a vertical conveyer and carried by such conveyer to a suitable level above the platform where a worker receives the bricks and puts them in position while taking care that the requisite fit and the prescribed dilatation joints are realized.

One of the greatest problems inherent in this prior art apparatus is the problem of conveyance and particularly the problem of how the material shall be transferred to and from the vertical conveyer in the converter. If the vertical conveyer is of constant length and of constant location in the converter during the entire course of the work, the platform must be movable in relation to the conveyer to permit being raised and lowered, in which case either the level of the discharge point with respect to the platform is altered, which is highly unsuitable, or the vertical conveyer must have several discharge points, which is inter alia dangerous. An alternative is to use relatively short vertical conveyers of constant length which may be shifted together with the platform, but this also entails problems which have not been satisfactorily solved.

If use is made, for instance for works in an open-top or open-bottom converter, of a vertical conveyer of constant length and a horizontal or inclined conveyer connecting thereonto for moving material to the vertical conveyer, the horizontal or inclined conveyer must be able to be moved towards and away from the conveyer when the vertical conveyer in the converter is raised or lowered.

Another serious problem inherent in the prior art apparatus is the arrangement of the vertical frame which carries both the working platform and the vertical conveyer. If side walls are put up in a converter which is open downwardly during this work, the frame can be placed at ground level beneath the converter. The platform carried by the frame can then be lifted upwardly through the open lower end of the converter and moved further upwardly inside the converter by lifting of the frame on which the platform is carried. The distance between ground level and the lower end of the converter may, however, be considerable and so may the proper vertical length of the conveyer, for which reason the frame must be extendable. This has earlier been realised by enlarging the frame with sections from below as the frame is raised. Furthermore, it has also been suggested to extend the vertical conveyer in the same way, that is, by connecting sections thereonto.

A further problem is encountered at the discharge end of the vertical conveyer, where the material is to be received or possibly transferred to roller tables or similar work-facilitating aids.

Summarizing, the prior art apparatuses entail three main problems which in part are intimately bound up with one another, viz. (1) the problem of material conveyance, (2) the problem of how best to construct the frame of the working platform and (3) the problem of receiving and transferring the material from the vertical conveyer to the brickwork in the converter.

Furthermore, several other problems are also encountered, some of which are directly dependent upon the solutions which are chosen for the main problems, while others depend upon the safety requirements for the operation, the personnel on the working platform and the personnel at ground level.

SUMMARY OF THE INVENTION

An object of the invention is to provide a relatively easily operated apparatus which, as far as possible, is composed of per se known well-tested reliable components and permits a rapid continuous conveyance of the material in the correct order of sizes and shapes from a loading station to a constantly correct height level for the personnel on the working platform.

A specific object of the invention is to provide, for an apparatus of the kind referred to, an extendable platform frame including vertical conveyer means which can be simply extended and shortened in conjunction with the extension and shortening of the frame. A further specific object is to provide work-facilitating conveying devices for transferring material from a loading station to a material receiving station on a level which is convenient with regard to the working platform and for transferring the material from this station to the location where the material is to be placed for bricking up a lining, for instance in a converter.

According to the invention the apparatus includes a vertical frame for supporting a working platform and conveyer means comprising a vertical conveyance path for conveying material to the platform and a supply path for conveying material to the vertical conveyance path. The vertical conveyance path and the supply path are constituted by two runs of an endless conveyer and one of the runs is extendable by shortening of the other run and vice versa.

Further objects and features of the invention will appear from the following description, reference being made to the accompanying drawings in which the invention is illustrated only by way of example in conjunction with work carried out for the lining of the side walls of a converter which is open downwardly during this work.

DETAILED DESCRIPTION OF THE INVENTION

Figure 1:
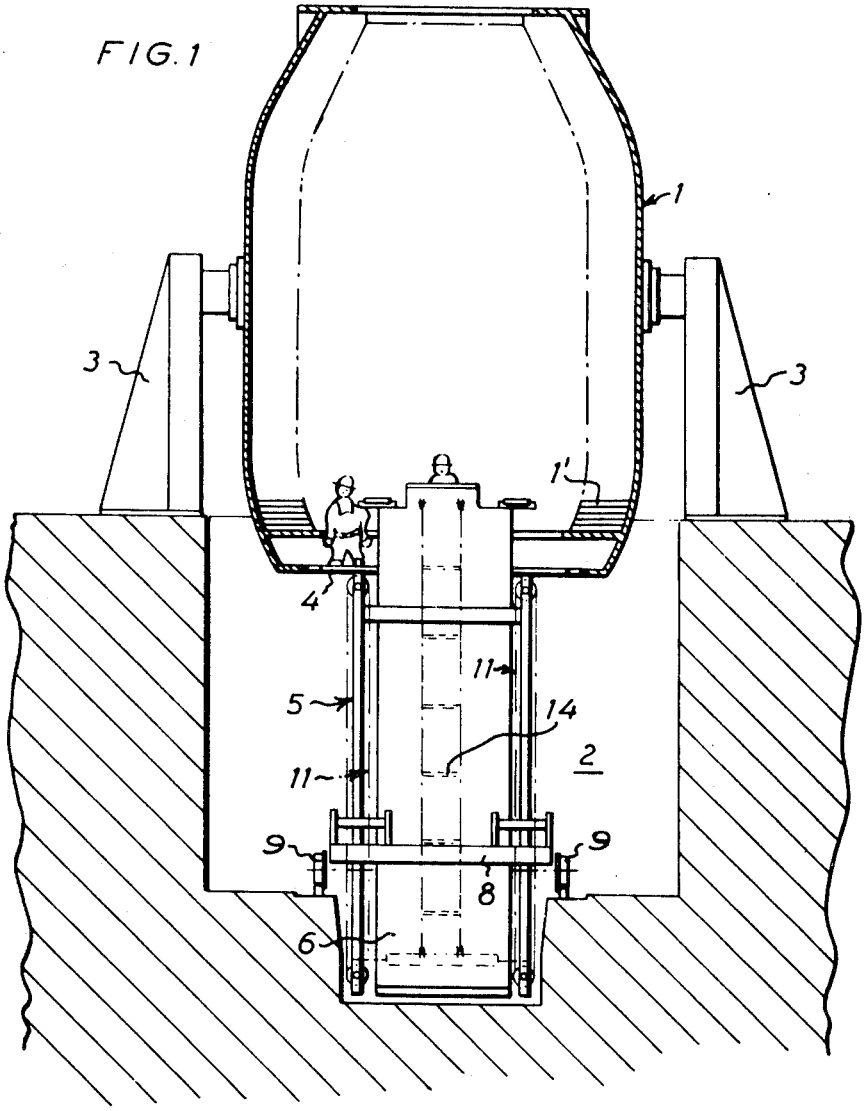
FIG. 1 is a schematic and fragmentary vertical sectional view of a converter and an apparatus according to the invention with material conveyer means and a working platform in a working position.
Figure 2:
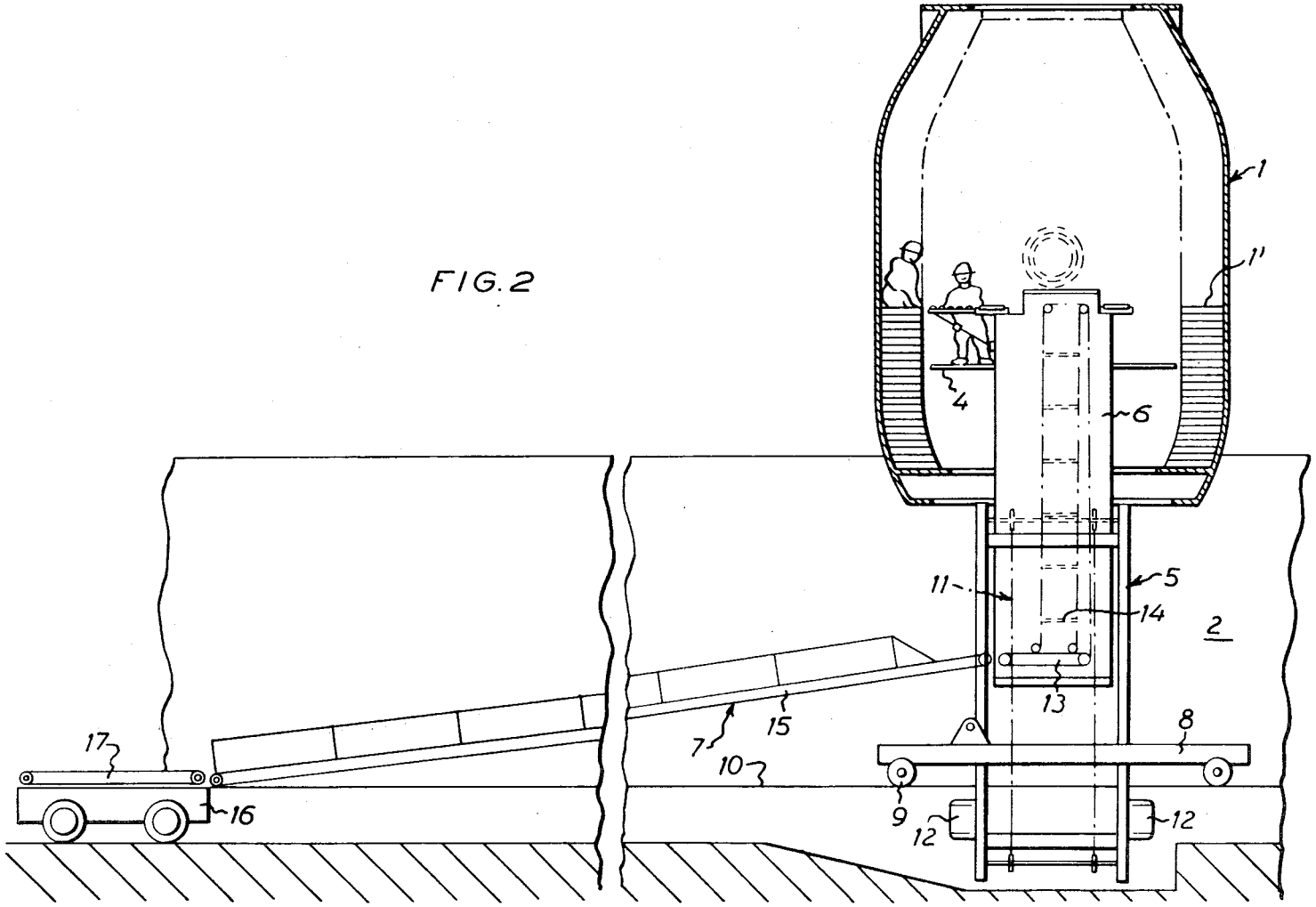
FIGS. 2 and 3 are views similar to FIG. 1, but showing the converter as seen at an angle of 90° with respect to FIG. 1 and the apparatus according to the invention in two other working positions during the lining of the converter in FIG. 1.
Figure 3:
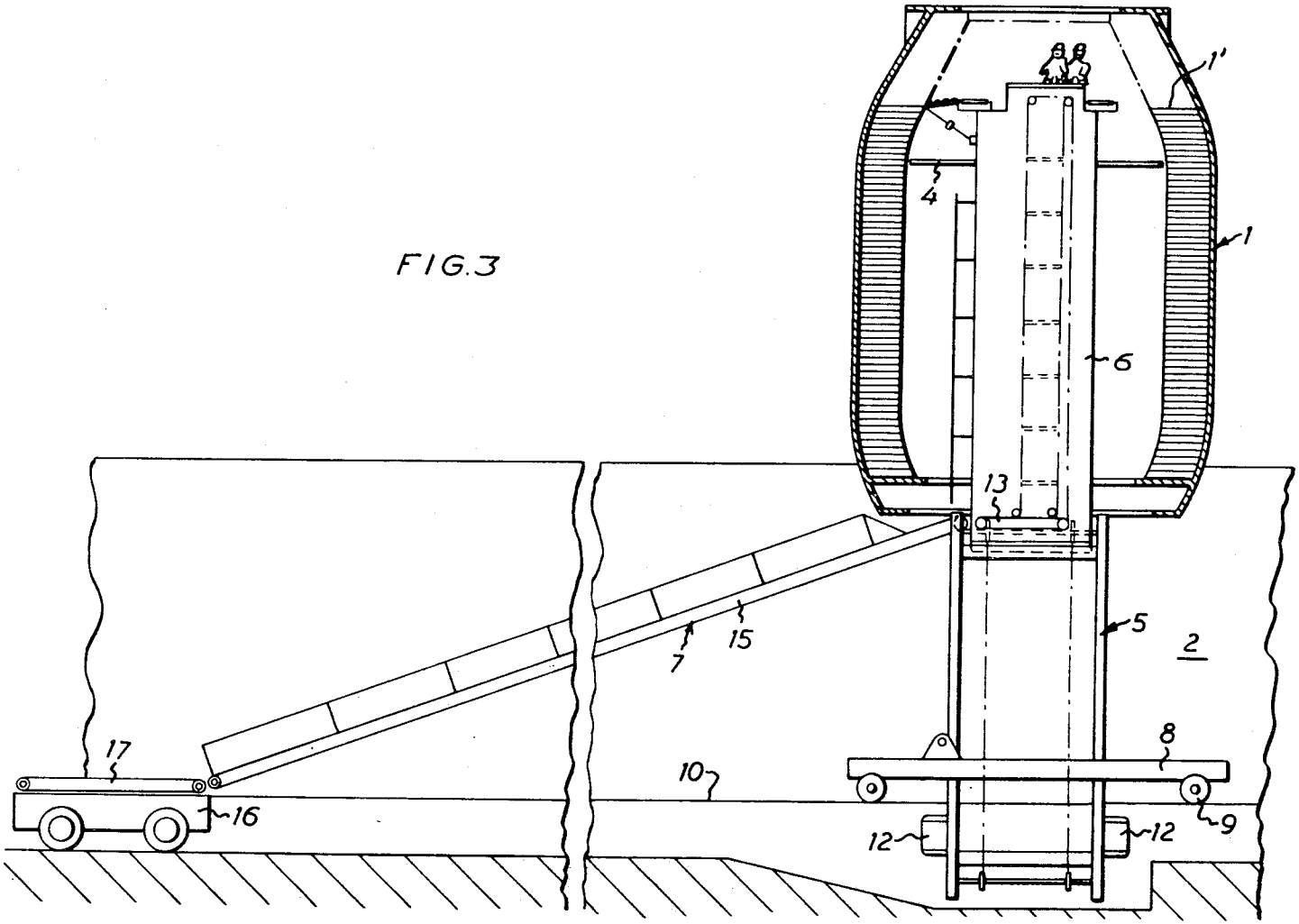

The converter 1 illustrated in FIGS. 1 to 3 by way of example of the use of the apparatus according to the invention is supported above a shaft 2 by a frame 3 which may be movable in a direction parallel with the shaft. The bottom of the converter has been removed, the old brickwork has been torn out and the work for placing a new brick lining 1' is in progress. This work is carried out from a platform 4 which is included in the apparatus according to the invention.

This apparatus comprises a frame 5 with a raisable and lowerable tower 6 which carries the platform 4 and contains a vertical conveyer means for the conveyance of material to the platform from a conveyer means 7 located outside the tower 6 for the conveyance of material to the tower.

The frame 5 includes a subframe 8 which is in the form of a carriage having steel wheels 9 and being thus movable on rails 10 provided (in this case) beneath the converter. In the case illustrated the lower portion of the frame 5 (and in the position shown in FIG. 1 also the lower part of the tower 6) extends downwards into a recess (slag pit) of the shaft 2. The subframe 8 carries a tower lifting means generally designated 11 (see FIG. 1). With the aid of this lifting means the tower 6 and the platform 4 carried by the tower can be moved upwards and into the converter through the downwardly facing open end thereof. The lifting means 11 may for instance be chain and sprocket wheel transmissions and electrical drive motors 12.

In FIGS. 1 to 3 the frame 5 is shown in the form of a framework structure, and the tower 6 in the form of a sheet metal tube which is movably guided by four vertical guides. However, in a preferred embodiment schematically illustrated in FIG. 4 and to be more fully described with reference to FIGS. 4 to 15 the frame 5 preferably is in the form of a telescopically extendable tube.

According to FIGS. 1 to 3 the conveyer means in the tower 6 comprises a short horizontal belt conveyer 13, which is installed in the lower part of the tower, a vertical conveyer 14 extending upwardly from conveyer 13, and a relatively long belt conveyer 15 one end of which is connected to the lower part of the tower 6 for conveyance of material to the short belt conveyer 13 in the lower part of the tower. The other end of the conveyer 15 is supported on a carriage 16 and connects onto a short horizontal belt conveyer 17 disposed on the carriage. When the tower 6 is moved upwards or downwards the carriage 16 with the belt conveyer 17 and the outer end of the belt conveyer 15 is moved in a horizontal sense toward or away from the tower simultaneously as the belt conveyer 15 is inclined at a greater or smaller angle to the horizontal plane. The conveyer 15 therefore must have so large a length that its inclination at the maximum height position of the tower is only so great that it is capable of conveying material from the conveyer 17 on the carriage 16 to the conveyer 13 in the lower part of the tower.

Figure 4:
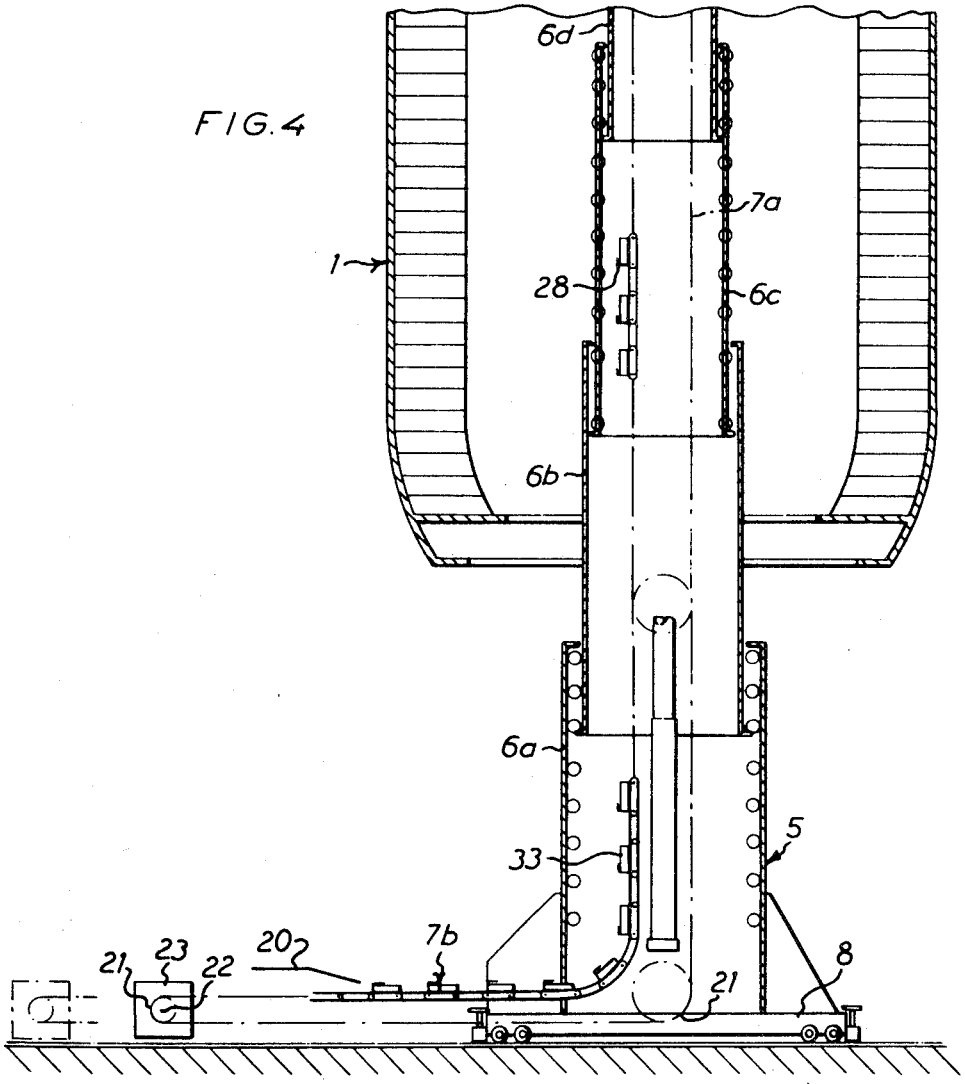
FIG. 4 is a view similar to FIG. 1, but showing schematically and fragmentarily a preferred embodiment of the apparatus according to the invention.

In the preferred embodiment illustrated schematically in FIG. 4 and in somewhat greater detail in the following figures the tower 6 consists of a telescopically extendable structure which comprises a number of coaxial telescoping tubes 6*a*–6*d*. The outermost tube 6*a* is carried on the subframe 8 and replaces the frame 5 in FIGS. 1–3, while the innermost tube carries the working platform 4 at its upper end. The lifting means 11 which is carried on the subframe 8 and is arranged for telescoping extension of the tower, here is in the form of a pair of hydraulic telescoping cylinders.

The conveying means 7 in the preferred embodiment (see FIG. 4) is an endless chain conveyor which replaces the conveyors 13, 14, 15 in FIGS. 1–3 and includes a run 7*a* located inside the tower and a run 7*b* located outside the tower. The inner run 7*a* forms a vertical conveying path which is readily extendable and shortenable in conjunction with a shortening and extension, respectively, of the outer run 7*b* which constitutes an outer conveying path. The extension and shortening of the inner run 7*a* is performed in conjunction with a telescoping movement for extending or shortening the tower structure 6.

The outer run 7*b* of the chain conveyer is adapted to convey building material from a loading station substantially in a horizontal direction to the lower end of the tower 6, from where conveyance proceeds in vertical direction by means of the conveying run 7*a* inside the tower up to a receiving station at the working platform 4.

According to the invention, the outer run 7*b* of the chain conveyer is supported in an outer channel-shaped structure 20 which for the sake of simplicity is hereinafter termed "channel" and the length of which substantially corresponds to the maximum length of the outer run 7*b*. The outer run 7*b* passes over sprockets 21 mounted in pairs on common shafts. At the outer end of the section 7*b* the sprocket 21 is carried on a shaft 22 which is mounted on a carriage or slide 23 movable along the channel 20 and connected for instance by wires 24 to a stretching means generally designated 25. The stretching means may be a rope drum driven by a pneumatic or electric motor and may include means 26 sensing the stress of stretching. The channel 20 at its upper end has an opening through which material can be transferred to the outer conveyer run 7*b*, and in a preferred embodiment a loading conveyer 27 is mounted on the channel above the outer run 7*b* for transferring material to the outer run 7*b* of the chain conveyer.

The chain conveyer 7*a*, 7*b* has dogs 28 (see FIG. 5) and the loading conveyer 27 is adapted, via an inclined plane, to transfer the material to the outer conveyer run 7*b* so that the material is grasped by the dogs 28 thereof. The inclined plane may be formed by a pivotally mounted plate which is automatically swung down by the material and is then automatically swung up by a return spring. However, this is actually not necessary, for in a simple case the inclined plane may be an inclined guide 29 on which the material slides onto the conveyer run 7*b*. The guide 29 may be or terminate in a grid structure with fingers 29' on which the material is transferred to the conveyer run 7*b*.

At the upper end (see FIGS. 10–12) the chain conveyer run inside the tower delivers the material to a receiving plate 30 which is carried by the tower structure 1. The receiving plate is preferably annular and rotatably mounted on the tower structure by means of ball bearings 31 and is driven by a motor, for instance an electric motor 32 (see FIG. 13). When the material, such as 33, carried by the dogs 28 reaches the upper end of the inner conveyer run 7*a*, where such run passes over sprockets 34 and where the dogs 28 (illustrated only schematically in FIG. 10) from having moved upwards are turned so as to move downwards, the material is released so that it fails preferably onto an inclining guide which receives the material, substantially in the manner of the lower part of a ski slope receives a ski-jumper, to slide on the guide 35 to the rotatable annular plate 30. From the plate 30 the material is transferred via a guide 36 to a roller table 37 carried by the tower structure and movable around it. The material is transferred by roller table 37 to the location where it is to be placed.

The roller table 37 which will most clearly appear from FIGS. 11–15 has preferably at the outer end a pivotally mounted support plate 37' by means of which the material, such as lining bricks 33, can be supported while being transferred from the roller table 37 ("the serving table") to the bricklaying site (the brickwork 1'). The support plate 37' can then be swung away by means of a handle 38 so that the material will be delivered to the correct or approximately correct location on the brickwork 1' without damaging the backing which may be covered for instance with expansion material, such as cardboard.

The channel 20 in which the outer run 7*b* of the chain conveyer is carried, is preferably composed of sections 20*a*, 20*b*. These sections can be connected by hinges in such a way that the channel (for instance a steel structure like the tower) can be folded together and placed in a folded state laterally of the tower structure so that a compact easy-transportable apparatus is obtained. During transportation the chain conveyer 7*a*, 7*b* and its support means need not be removed from the channel. Thus, the conveyer 7*a*, 7*b* need not be removed either from the channel or from the tower structure when the apparatus is transported to and away from a converter.

As already mentioned, the tower structure 1 in its preferred embodiment comprises an outer stationary tube 6*a* and several tubes 6*b*, 6*c*, 6*d* telescoping in tube 6*a* and in each other. The innermost tube 6*d* at its upper end carries a suspension device 41 for the annular plate 30 and the working platform 4 both of which surround the tower structure. The suspension device 41 is a steel tube of larger diameter than that of the frame/tube 6*a*, such steel tube having an upper end wall 41' which rests on and is fixed to the upper end of the innermost tube 6*d*. The tube 41 carries the platform 4 at its lower end (see FIG. 8) and via brackets 48 carries the support bearing 31 (FIG. 13) for the rotatable annular plate 30. The innermost tube 6*d* is so arranged that it can protrude over the tubes 6*a*, 6*b*, 6*c*. The lifting means 11 for extending the tube structure comprises, in its preferred embodiment, two hydraulic telescoping cylinders 42 which are operative between the subframe 8 and the innermost tube 6*d* at a fastening 47. When the innermost tube 6*d* reaches its outer position it is engaged via engagement means 43 with the closest outer tube 6*c* so that tube 6*c* can then be moved to its outer position, after which last-mentioned tube 6*c* is engaged with the next tube etc. The outermost tube 6*a*, however, is fixedly connected to the subframe 8.

The subframe 8 is preferably supported on hydraulically operable feet 44 and can be set with the aid of level determining means, such as levels 45, and besides has arrestable screws with feet 46 for fixation of the subframe and the frame (the outer tube 6*a*) in the set position. The working platform 4 preferably has a means which permits increasing the outer diameter of the platform so that the platform deck is always continuous. To this end, the platform 4 includes an inner annular portion 50 which underlaps or overlaps an outer annular portion consisting of a number of sector-shaped discs 51, 52, every second disc 51 overlapping the edge portions of the intermediate discs 52. The discs are movable by means of pressure fluid cylinders 53 for respectively increasing and reducing the diameter of the platform. Moreover, the platform 4 has a safety device 54 which senses pressures against the outer edge of the platform and prevents an increase of the diameter on the platform when a pressure of a certain size is sensed. This device can be connected to the pressure fluid system and so arranged as to automatically render an outward displacement of the sector-shaped discs impossible when obstacles occur.

Figures 5, 7:
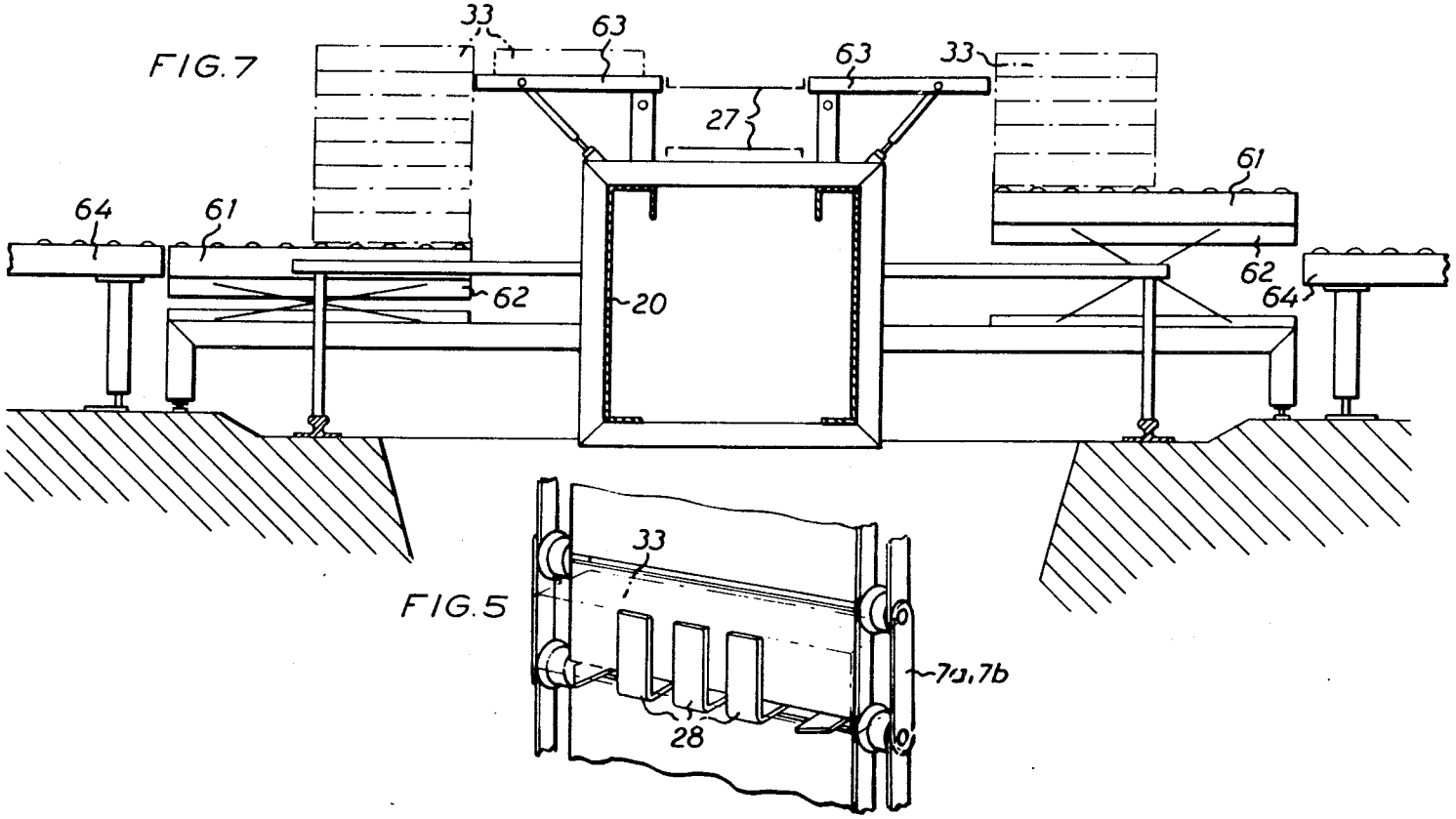
FIG. 5 is a schematic perspective view of part of the chain conveyer and a dog in the apparatus shown in FIG. 4.
FIG. 7 is a section on line VII—VII in FIG. 6.
Figure 6:
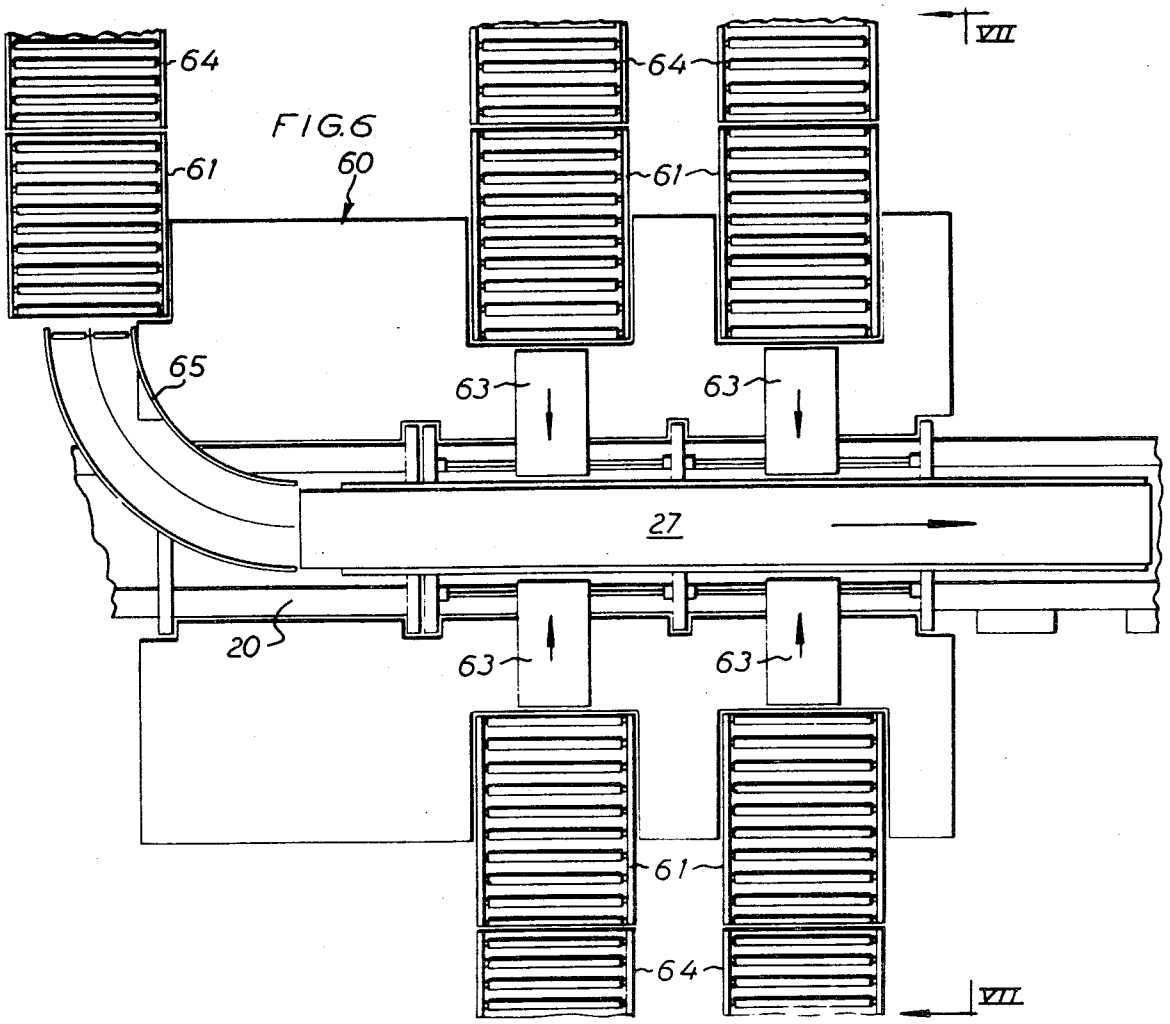
FIG. 6 is a plan view of a loading station with a transfer conveyer for transferring material to the chain conveyer in FIG. 4 and also shows how the loading station can be combined with the apparatus in FIG. 8.

The conveying means further comprises a number of roller conveyers or so-called roller tables in a reloading station 60 which is shown in FIGS. 6 and 7. The building material, such as filling-in material loaded into bags (not shown) and bricks, is transported to this station and then transferred to the transfer conveyer 27 which transfers the material to the outer run 7*b* of the chain conveyer 7*a*, 7*b* in the described manner. The material is transported to the station 64 on pallets which are transferred to roller tables 61 carried by raisable and lowerable hydraulic lifting gear 62 of the well-known type that will clearly appear from FIG. 7 From the roller tables 61 the material is transferred to the conveyer 27 (a belt conveyer) via planar tables 63 or roller tables. The station 60 may comprise several roller tables 61 with hydraulic lifting gear 62 on either side of the transfer conveyer 27 and possibly a number of roller tables and guides 65. All of these units are dismountable to permit easy mounting after the tower 6 and the channel 20 have been placed in position.

Figure 8:
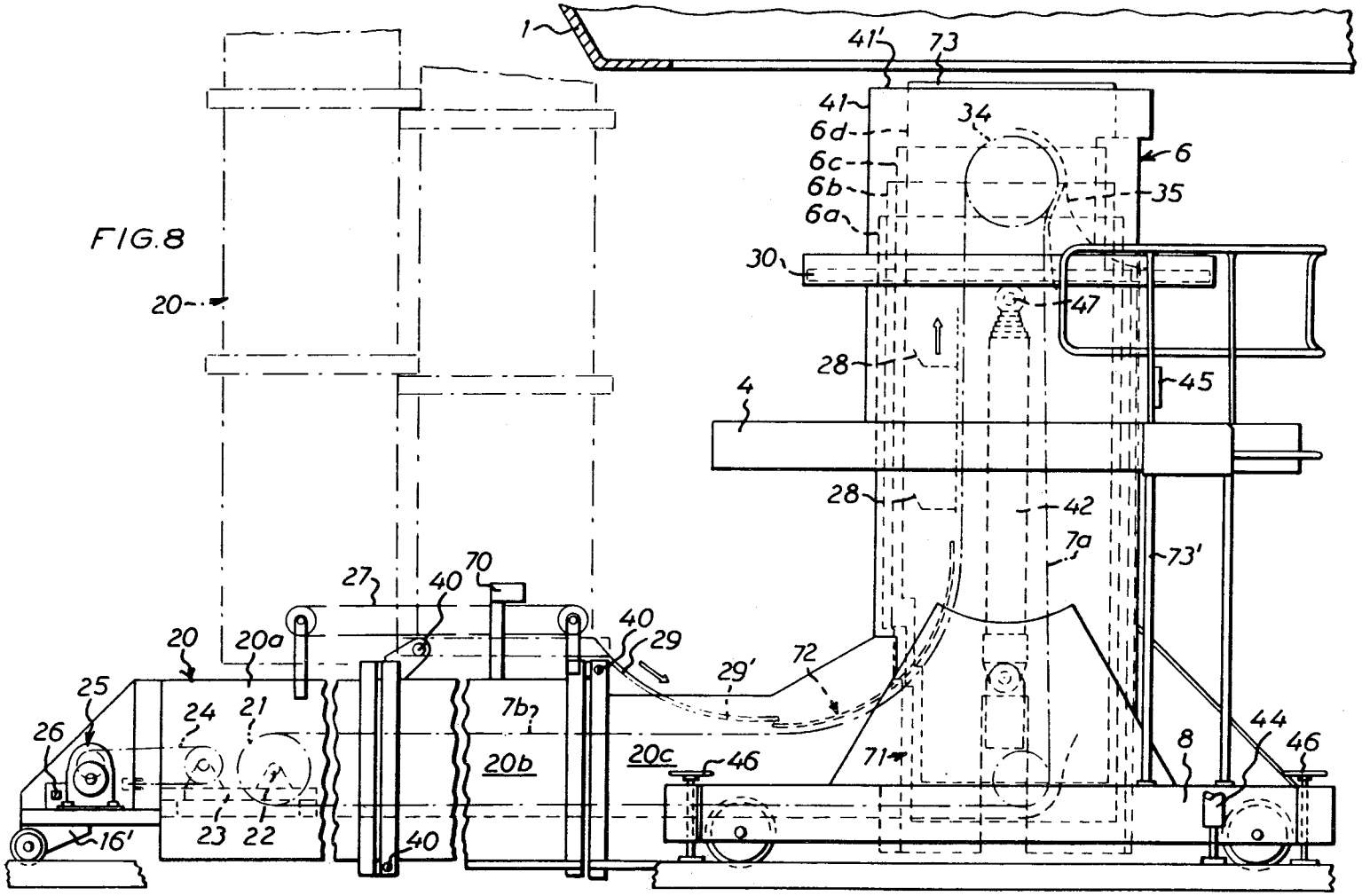
FIG. 8 is a schematic fragmentary side elevation of a preferred embodiment of the apparatus according to the principle illustrated in FIG. 4.
Figure 9:
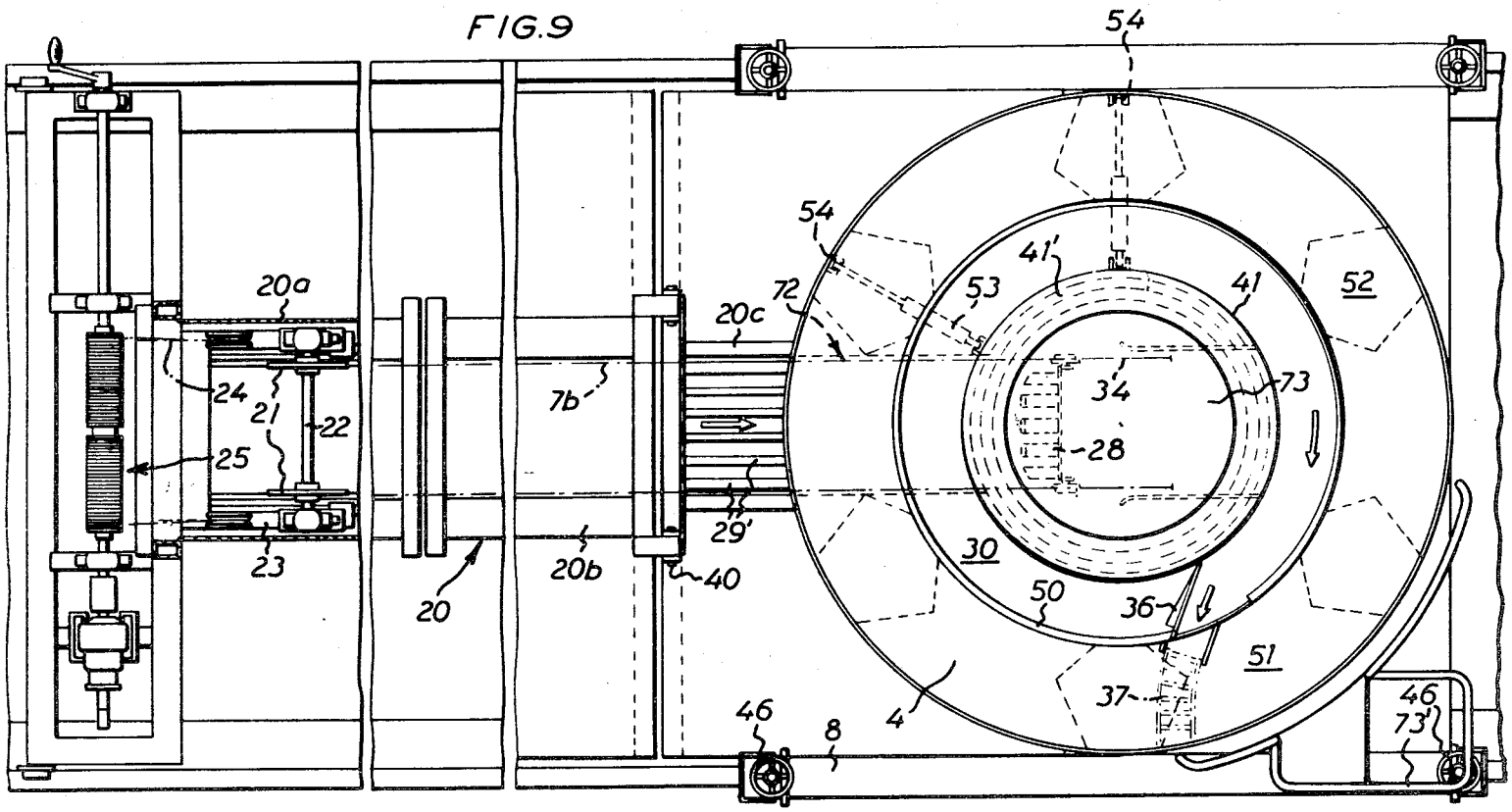
FIG. 9 is a plan view of the apparatus in FIG. 8.

In order that each brick and each bag of filling-in material shall be transferred separately from the conveyer 27 to the outer run 7*b* of the conveyer 7*a*, 7*b* the transfer via the inclined plane 29 (see FIG. 8) is supervised by photoelectric cells which are connected to the drive (not shown) of the conveyer 27 and to the drive (not shown) of the chain conveyer 7*a*, 7*b*. These drives preferably are electric motors, of which at least the drive for the chain conveyer 7*a*, 7*b* is reversible to permit operation in the reverse direction. FIG. 8 only diagrammatically shows a photoelectric cell means 70 for the above described supervision but of course several such photoelectric cell means can be utilized in the automatic supervision system to stop the conveyers in the event of congestion of material.

To make it possible for the personnel in the converter to work at maximum efficiency it is imperative that the bricks be transported up to the platform in the correct order. The respective steel works furnish brick lists and drawings for the lining work. The bricks on the pallets shall be marked course by course with statements of the brick dimensions (sizes and shapes) and quality. Combinations of bricks of different types must not be loaded onto the same pallet. Should for instance four kinds of bricks (brick dimensions) be comprised in a course, the bricks at the distribution according to this system can be placed on four pallets on the roller table, from which pallets the bricks are placed in turn of order and number on the conveyer belt 27 for continued transport by means of the chain conveyer 7*a*, 7*b* to the working site in the converter. Thus all bricks are well marked by dimension and quality, and at the delivery of the bricks to the place of destination a representative from the brick supplier should be present to supervise and take the responsibility for the material being loaded, conveyed and placed in the correct order of courses at a location where the material is kept in store until it is to be used. The first course shall therefore be first accessible and the following courses shall be accessible in the correct order up to the last course. The requisite filling material (between the converter jacket and the wear-resistant lining and brick lining, respectively) shall of course also be available at the site for conveyance to the converter.

Starting from the first course the pallets are placed by forklift truck on roller tables in the station 60, and it is of the utmost importance that this takes place in the correct sequence.

The representative of the brick supplier shall see to it from ground level that (a) the correct courses and the correct brick sizes and shapes for these courses are placed in the correct order on the roller table, and (b) that the correct combination is placed in the correct order on the conveyer belt and that the bricks will be laid in the correct order on the brickwork course by course.

A representative of the brick supplier should be present also on the working platform (a) to check that his colleague at ground level has directed the correct material from the respective pallet for the respective course up to the platform, and (b) to give directions and instructions to the effect that the material inclusive of the prescribed expansion material (sheet of combustible material, such as cardboard, which is placed between the bricks at predetermined locations) will be correctly disposed in the brickwork.

The belt conveyer 27 on the channel 20 may have a horizontal length of between 2 and 3 m, and a width of about 40 cm and need not be synchronized with the chain conveyer 7*a*, 7*b* owing to the described arrangement thereof. The chain conveyer 7*a*, 7*b* shall be of such a length that the outer run 7*b* thereof is well below the receiving point at 29′ when the tower 6 is extended to its maximum height and the inner run 7*a* consequently has its largest length (at the cost of the length of the outer run 7*b*).

The material conveying run of the chain conveyer is guided, at its passage through the opening at 71, in the tubes 6*a*, 6*b*, 6*c*, 6*d* by a circular guiding device 72.

The lifting means for telescopically extending the tower with respect to the subframe 8 can be controlled by operating equipment which is placed on or in the upper part of the tower as to be easily accessible to the personnel on the tower.

The tower 6 externally has hand and step irons (see FIGS. 2, 3) which lead to the working platform, and should have a ladder to facilitate supervision and maintenance. Such ladder may be disposed on the outer side of the tower, for instance at 73′ in FIGS. 8, 9. Moreover, the platform has a refuse chute. At the top of its upper wall 41′ the tower may have a door 73 or a grid whereby the tower can be utilized as a ventilating duct for aeration of the converter during work.

Figure 10:
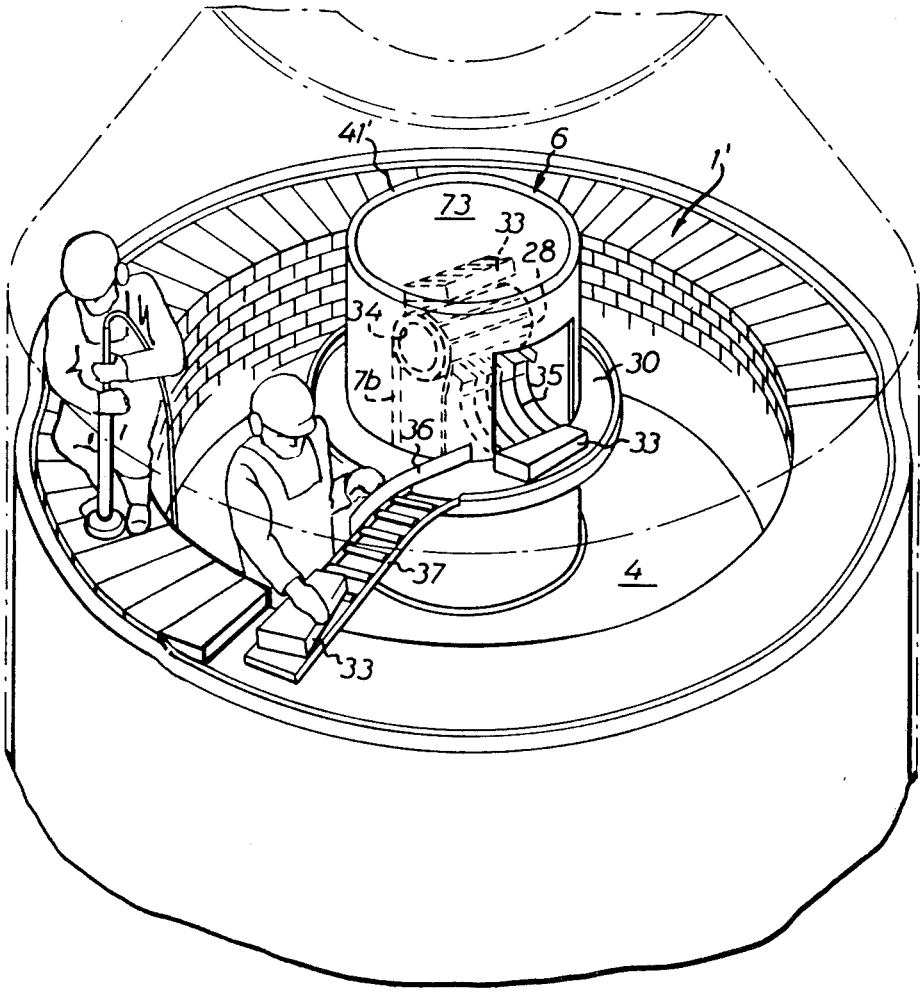
FIG. 10 is a schematic perspective view of the upper part of the tower in FIGS. 8 and 9 while work is done in a converter.

At the upper end of the vertical conveyer run 7*b* the conveyed material is discharged via the guide 35 through an opening at the upper part of the tower to the circular rotatable plate 30 (see FIG. 10). From there, the material is transferred in the manner described to the roller table 37 which forms a "serving table" and extends to the crest of the brickwork. The circular roller table 37 is carried by a ring 75 (see FIGS. 12, 13) rotatably mounted at the outer circumferential edge of the plate 30 and can be moved by a worker on the platform around the tower 6 and thus relative to the annular material receiving and conveying table 30 which as earlier mentioned consists of an annular rotatably mounted plate. The ring 75 and the serving table 37 are at a height of about 1 m above the working platform (the most convenient height for the brick layer) and the inner end of the serving table 37 is on the same level. The table 37 should be either of adjustable length or enlargeable by means of sections, such as the section 37″ in FIGS. 14, 15 which show a modification of the embodiment in FIGS. 11 to 13.

The laying of the bricks as a rule takes place counterclockwise, the serving table 37 being moved counterclockwise as the work proceeds. In the manner described, the bricks can easily be transferred from the circular table 30 (driven counter-clockwise) to the serving table 37 and is transferred to the table directly at the point of the brickwork crest where the bricks are to be placed. The bricks need not therefore be lifted by hand.

In addition to the electric control equipment for the conveyer 7*a*, 7*b* the tower has telephone equipment for establishing contact between the working platform 4, ground level and desired locations. Furthermore, the tower is equipped with a compressed air connection from ground level to the working platform and with electric power taps (for illumination, power supply to the requisite machines). All of these connections are built into the upper and lower parts of the central tower so that connection as well as rapid starting of the operation is readily effected.

With the aid of the control equipment the receiver of the material on the working platform can stop and start all necessary operations, such as the drive of the circular table 30 around the upper part of the tower, the conveyer 7*a*, 7*b* and the drive for the telescopically extendable tower 6. Moreover, as already mentioned, the conveyer 7*a*, 7*b* can be reversed to bring about return of material. During normal operation of the conveyers the conveying system described provides a feed rate of about 15 bricks per minute or more. While the vertical conveyer 14 and the transfer between the vertical conveyer 14 and the outer conveyer 15 in the embodiment of FIGS. 1 to 3 can be considered as the most critical links of the conveying system, which may cause problems, these problesm are entirely avoided in the embodiment of FIGS. 4 to 15, which ensures that the indicated conveying capacity can be maintained or even increased without disturbances.

The laying of the bricks can be performed by any normally skilled operator who need not be a professional bricklayer. At a correct setting of the serving table 37 and by the fact that the bricks are fed in the order described each brick will almost automatically arrive in the right position, and the only thing the bricklayer normally needs to do is to see to it that the bricks are transferred from the driven roller table 30 to the serving table 37 and that the last-mentioned table is correctly aligned, and to carry out minor adjustments of the positions of the bricks in the brickwork. As shown in FIGS. 1 to 3 and 10 one man positioned on the brickwork, after the laying of the bricks, attends to the stamping of the bricks and the filling material (which like all other materials can be carried up to the platform by the conveyers). Should a brick of incorrect size and shape arrive (which should be noticed by the supervisor) this mistake can be rapidly corrected. Such mistakes should not normally occur. The conveying system described also possesses the advantage that the bricks are conveyed in a lenient way without any risk of impacts, shocks or falls which may damage the bricks.

As shown in FIG. 10 the tower 6 at the top has a supporting roof 41' (possibly with a door 73 therein), which is at a higher level than the circular table 30. This roof 41' preferably constitutes a loadable plane which can be used for storage and unloading of material. On this plane there may be stored bricks which are used for finishing the lining of the converter in the uppermost portion of its frustoconical top section where the working platform 4 and the serving table 37 cannot be used for one reason or other because of lack of space between the brickwork 1' and the tower 6.

The working platform 4 can be enlarged or reduced with regard to width so as to conform to the inner diameter of the brickwork 1' whereby it will bear against the brickwork and thus support the tower. An enlargement of the width (outer diameter) of the working platform can be effected in the manner earlier described or for instance by laying or projecting sections on supports, for instance telescopically extendable beams. Naturally, there are many other ways of enlarging (or reducing) the width of the working platform, the essential thing being that the carrying capacity of the working platform is reliable and that the platform imparts to the tower the requisite stability, particularly in the highly upwardly extended position of the tower, such as in FIG. 3.

It will appear from FIGS. 1 to 3 that the vertical conveying height may be constant to permit using a tower 6 of definite length. Upon upward projection of the tower 6 of the level of the vertical conveyer is of course altered, but the length of the vertical conveyer from the lower to the upper end of the tower can remain unaltered since the outer belt conveyer 15 conveys the material to the supply end of the tower independently of the height level thereof. In that case the conveyer 15 shall be pivoted to the lower end of the tower 6 and to the carriage 16 which can be moved relative to the conveyers in the station 60. The advantage gained by this arrangement is that neither the tower 6 nor the vertical conveyer 14 need be lengthened. For the above reasons the arrangement of the tower 6 and the conveyer means 7 according to FIGS. 4 to 10 must be considered by far superior and is therefore preferred.

Should it not be possible in some cases for reasons of space to move the tower frame and the tower 6 beneath an apparatus, such as the converter 1, in which works of the type outlined are to be carried out, the frame and/or the tower may be introduced from above, whereupon the frame is connected with a subframe of some kind.

In some cases it is also possible to use the tower 6 and the conveyer means 7 or 7*a*, 7*b* in an entirely reversed position with regard to the position in FIGS. 1 to 3 and 4, that is, the equipment may be used in such a way that the tower 6 is inserted from above and that the conveyer extends up to the upper end of the tower. The lower end of the tower can then be in a lowermost position at the beginning of the work, and, as the work proceeds, the tower with the platform (which is carried near the lower end of the tower) is then moved upwardly. In this case a supporting device should be provided to support the tower over the apparatus in which the works are to be carried out.

Figure 11:
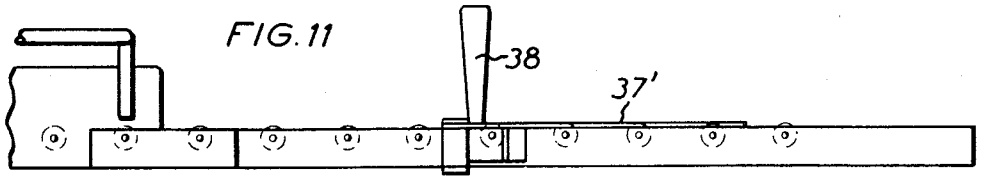
FIG. 11 is a side elevation of a roller table of the apparatus in FIGS. 8 to 10.
Figure 12:
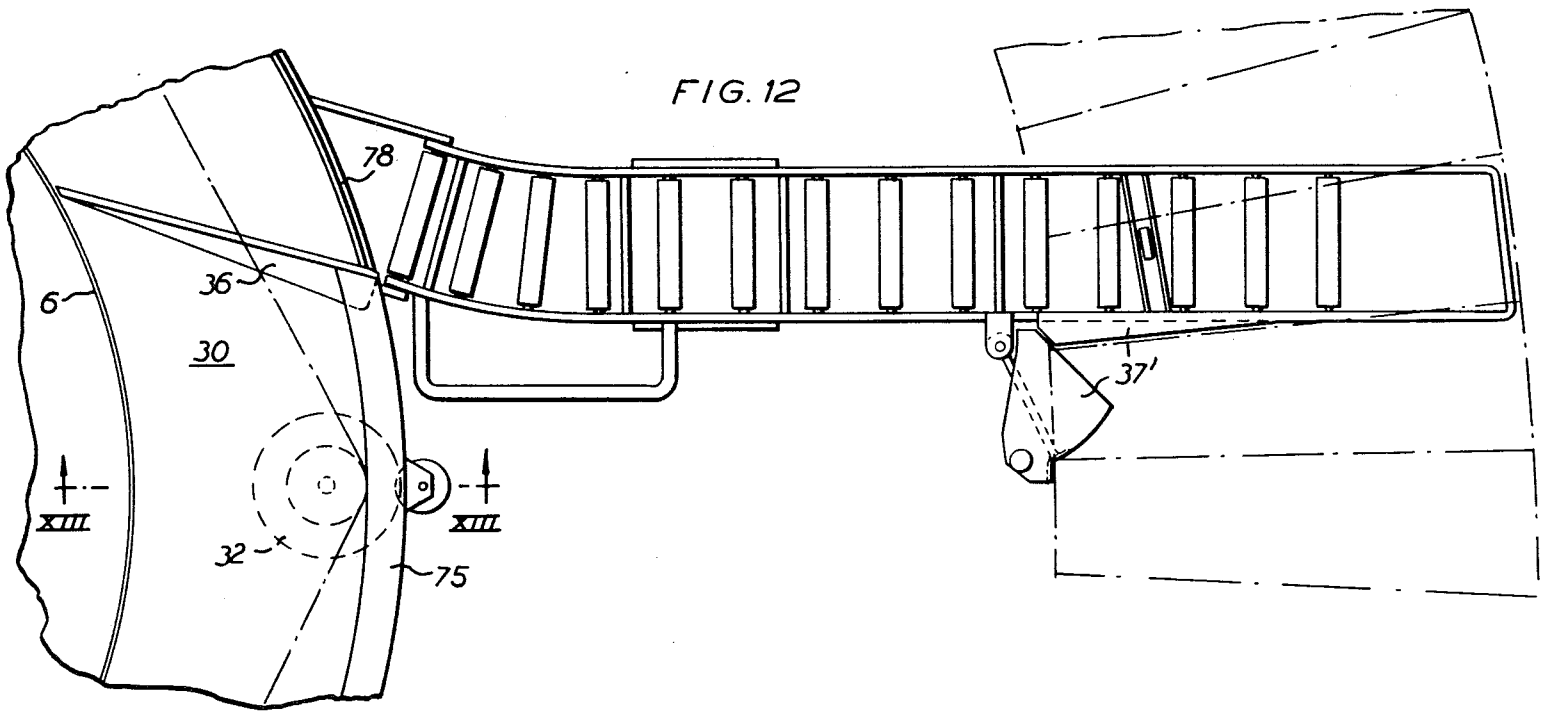
FIG. 12 is a plan view of the roller table in FIG. 11 and shows the mounting of the roller table on the tower.
Figure 13:
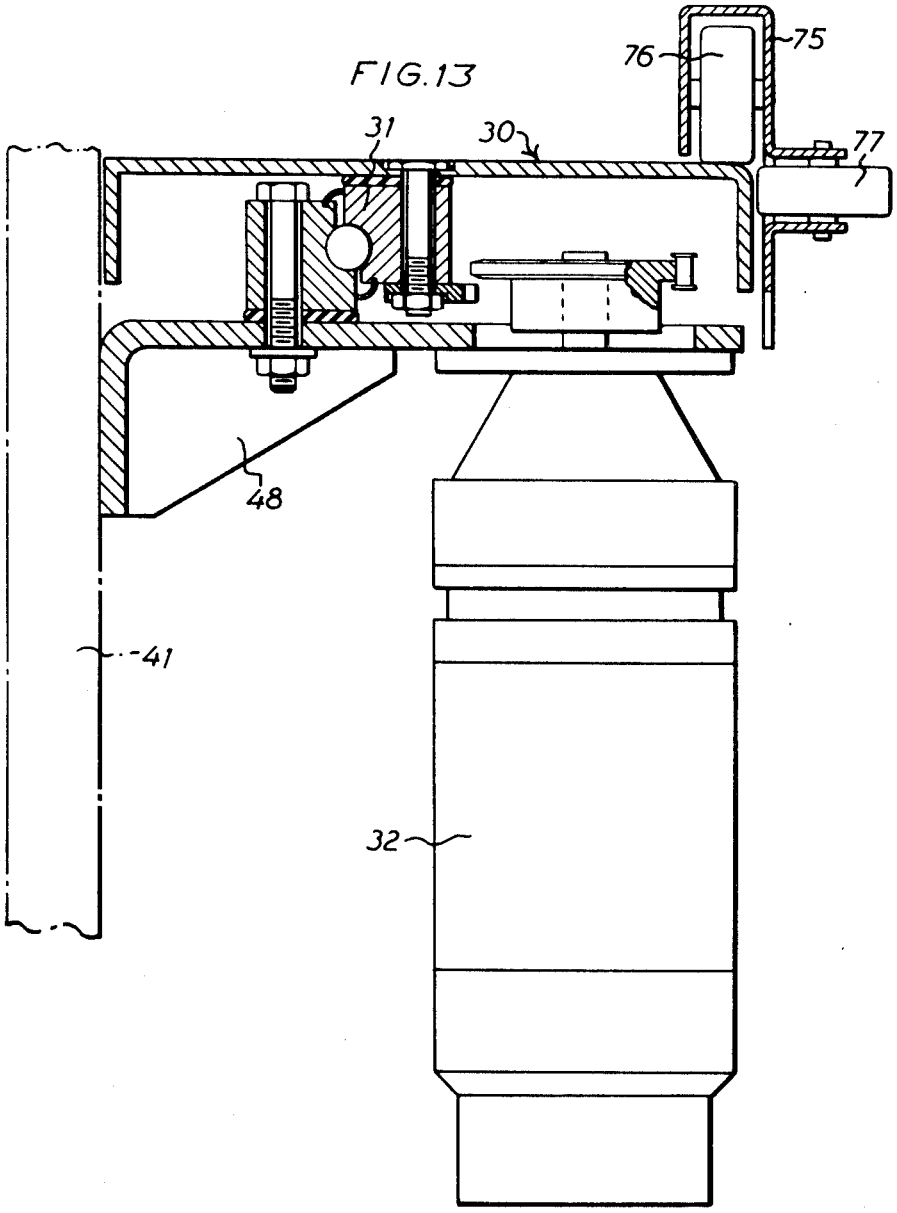
FIG. 13 is a section on line XIII—XIII in FIG. 12.

In the embodiment according to FIGS. 11 to 13 the ring 75 carrying the serving table 37 is supported on the outer edge portion of the rotatable circular table 30 by means of a number of rollers 76, 77 mounted pairwise at right angles to each other on the ring 75. The ring 75 protrudes somewhat over the plane of the table 30 to form an abutment which stops material fed out on the table 30 on the guide 35 (see FIG. 10). The ring 75, however, has a recess 78 in the area of the serving table 37 to permit transfer of material to the serving table 37. A guide 36 illustrated in FIGS. 10 and 12 is pivotally mounted so that it can be moved out of the path of movement of the material on the table 30 and allow the material to pass, if the worker does not have time to receive the material or if a brick of incorrect size should happen to arrive ahead of a brick of the correct size.

Figures 14, 15:
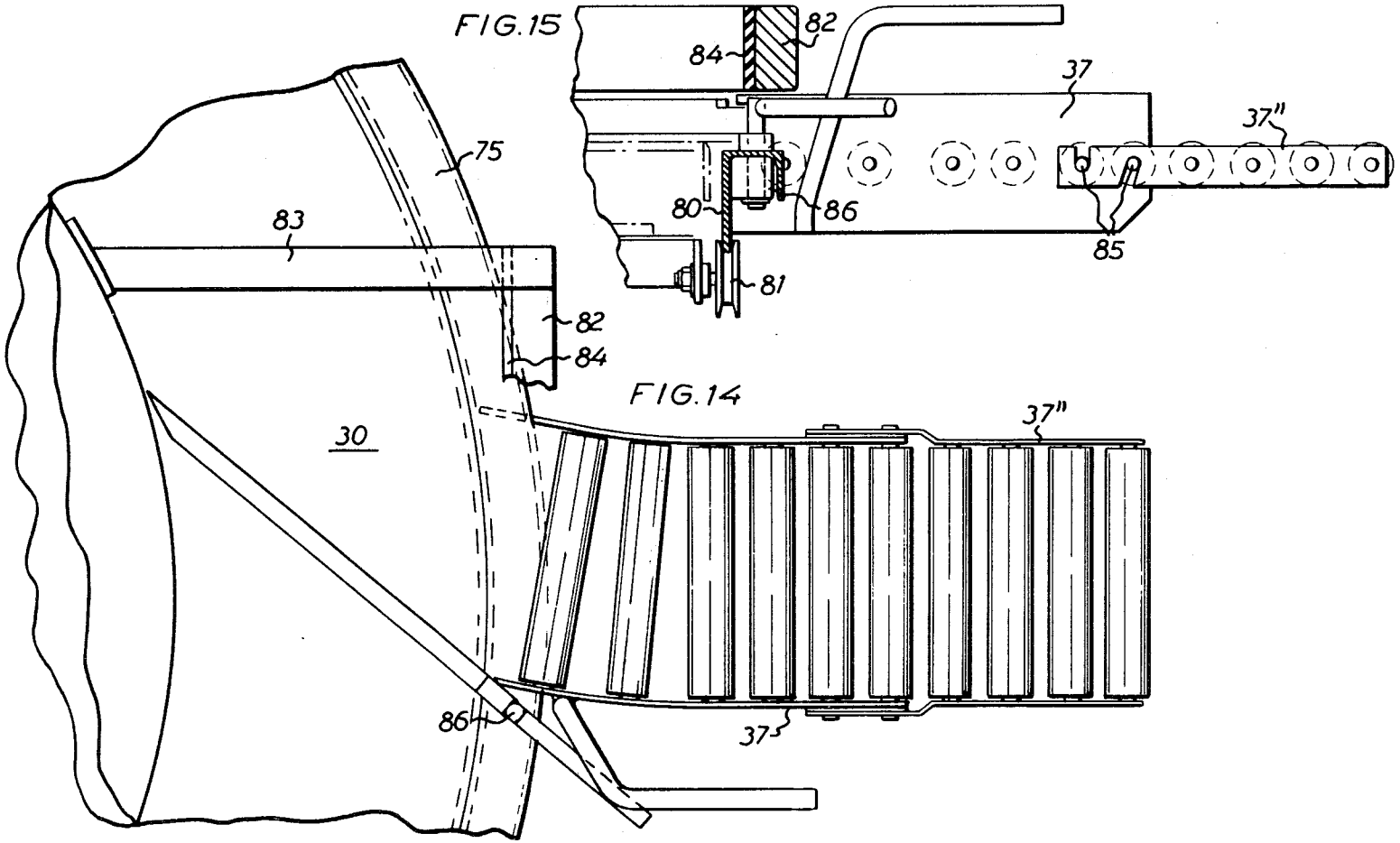
FIGS. 14 and 15 show a modification of the embodiment in FIGS. 11 and 12.

In the modified embodiment in FIGS. 14 and 15 the ring 75 has a substantially planar upper side which around the entire table 30 is on a level with the upper side of the table 30. The ring 75 is connected to and rests on an annular bar 80 which in turn is mounted on grooved rollers 81 supported by the table 30 at a level beneath the upper side of the table 30. To prevent material, which is fed from the guide 35 onto the table 30, from sliding outwardly off the table 30 and the ring 75, a buffer bar 82 is supported, in the modified embodiment according to FIGS. 14 and 15, by means of a holder 83 on the tower 6 in a region opposite the guide 35. Thus, in this embodiment the edge does not protrude above the table 30 around almost the entire periphery thereof, like in FIG. 10, but only over a short distance opposite the opening in the tower 6 for the guide 35, and the buffer bar 82 is stationary, which means that material cannot be transferred directly to the serving table 37 when the table is opposite the guide 35. This arrangement has been provided, on the one hand, to prevent the worker who receives material on the serving table 37 from injuring his fingers between the ring 75 and bricks conveyed around the tower on the table 30 and, on the other hand, to attenuate the impact of the bricks against a requisite stop means. For the last-mentioned purpose the buffer bar is coated on the inner side with an elastic material 84.

FIGS. 14 and 15 show that the extension member 37'' of the serving table 37 can readily be hooked onto hook means 85 on the serving table 37 when an extension of the table is desired. It is also shown that the wiper arm 36 is pivotally connected (for the above-mentioned purpose) to the table 30 by hinge means 86.

While preferred embodiments of the invention have been described above with reference to the accompanying drawings, it is readily understood that the invention can be modified in various ways within the spirit and scope of the appended claims.

What I claim and desire to secure by Letters Patent is:

1. An apparatus for facilitating the conveyance of material and the erection of walls of closed circumference from bricks, such as refractory bricks, and particularly for lining converters, metallurgical furnaces, such as blast-furnaces, holding vessels and like equipment, said apparatus comprising:

a vertical frame supporting a working platform;

conveyer means including a vertical conveyance path for conveying material to a discharging position at a level above said working platform and a supply path for conveying the material to said vertical conveyance path, said vertical conveyance path and said supply path being formed by two conveyer runs, one of said runs being extendable by shortening of the other of said runs and vice versa; and substantially horizontal conveying means, supported by and surrounding said frame, for receiving material delivered to said discharging position by the said conveyer run forming said vertical conveyance path and for transferring the thus received material in a substantially circular path and then to a selected construction position.

2. Apparatus as claimed in claim 1, wherein said horizontal conveying means comprises an annular plate rotatably supported by said frame at a position between said discharging position and said working platform.

3. Apparatus as claimed in claim 2, wherein said frame carries a drive for rotation of said annular plate.

4. Apparatus as claimed in claim 2, further comprising a roller table, supported adjacent said annular plate, for receiving the material from said annular plate and for transferring the material to said construction position.

5. Apparatus as claimed in claim 4, wherein said roller table is supported by a ring rotatably mounted relative to said annular plate and extending around the circumference of said annular plate.

6. Apparatus as claimed in claim 1, wherein said vertical frame comprises a movable subframe, a stationary frame portion fixedly positioned with respect to said subframe, and a plurality of sections telescopically extendable upwardly from said frame portion, a guide for the said run forming said vertical conveyance path being supported by the innermost of said sections, and hydraulic cylinder means supported by said subframe for telescopically moving said sections.

7. Apparatus as claimed in claim 1, wherein said two conveyer runs comprise runs of an endless conveyer.

8. Apparatus as claimed in claim 7, wherein said endless conveyer comprises a chain conveyer having thereon material entraining dogs.

9. Apparatus as claimed in claim 7, further comprising a support device for supporting said run of said endless conveyer forming said supply path, said support device being movable in the longitudinal direction of said supply path, and a stretching device connected to the movable support device for maintaining said endless conveyer in a stretched condition.

10. Apparatus as claimed in claim 9, wherein said support device comprises a channel structure which extends horizontally from a lower portion of said vertical frame, said endless conveyer forming a first conveyer, and further comprising a second conveyer at least partially supported by said channel structure for transferring material from a reloading station to said first conveyer.

11. Apparatus as claimed in claim 10, wherein said first conveyer comprises a chain conveyer having thereon a plurality of dog means, and said second conveyer includes drive means and has a discharge end for transferring material to said first conveyer in position to be gripped by said dog means.

12. Apparatus as claimed in claim 11, further comprising sensing means for sensing the transfer of material from said second conveyer to said first conveyer, said sensing means being operatively connected to said drive means for controlling the operation of said second conveyer and preventing discharge of material from said second conveyer to said first conveyer until a dog means of said first conveyer, which dog means has already grasped material, is transported a sufficient distance from said discharge end of said second conveyer to permit a following free dog means to grasp material at said discharge end.

13. Apparatus as claimed in claim 10, wherein said reloading station comprises liftable roller tables adapted to permit transfer of material along a transfer plane substantially on a level with said second conveyer.

14. Apparatus as claimed in claim 2, further comprising guide means, supported by said frame, for transferring material from said discharge position of said vertical conveyance path to said annular plate.

15. Apparatus as claimed in claim 14, wherein said guide means is concave so as to decelerate the rate of movement of the material.

16. Apparatus as claimed in claim 6, wherein said telescopically extendable sections comprise coaxial tubes which are at least partially retractable into each other, and said working platform is annular and includes a central tube which protrudes above the platform and is coaxial with the telescopically extendable tubes, said central tube having a diameter greater than said telescopically extendable tubes and being connected at its upper end to said innermost of said telescopically extendable tubes.

17. Apparatus as claimed in claim 1, wherein said working platform includes an inner portion fixedly connected to said vertical frame and an adjustable outer portion for adaptation of its diameter to a surrounding wall which is erected by workers on said working platform from material which is conveyed to said horizontal conveying means supported by said frame.

18. Apparatus as claimed in claim 17, further comprising operating means for adjusting said adjustable outer portion of said working platform, means for sensing the position of the outer circumference of said working platform in relation to the surrounding wall, lifting means for telescopically extending said frame, and means connected to said lifting means and adapted to prevent extension or shortening of said frame and thus vertical movement of said platform if the circumference of said platform is too close to the surrounding wall or is jammed against it.

19. Apparatus as claimed in claim 16, wherein said central tube of said platform and said innermost tube of said telescopically extendable tubes are interconnected at the respective upper ends thereof by a wall which closes said central tube and said innermost tube at said respective upper ends and forms a plate for supporting material and workers when work is performed in a narrow portion of a converter or like apparatus.

20. Apparatus as claimed in claim 16, wherein said tubes of said frame and said central tube are adapted to serve as a ventilating duct in works carried out in hot, gas-filled spaces.

21. Apparatus as claimed in claim 7, wherein said endless conveyer has a reversible drive controllable from said working platform.

22. Apparatus as claimed in claim 1, wherein said vertical frame is supported on a movable subframe including hydraulically adjustable feet and adjustable lockable feet for adjustment and fixation of said frame in relation to a base.

23. Apparatus as claimed in claim 1, wherein said conveyer means comprising said vertical conveyance path and said supply path comprises an endless chain conveyer, said chain conveyer supporting a plurality of spaced dogs, each of which is supported by a single run of said chain conveyer.

* * * * *